US012716678B2

(12) United States Patent
Blosser

(10) Patent No.: US 12,716,678 B2
(45) Date of Patent: Aug. 25, 2026

(54) COMPOUND BOW INCLUDING ADJUSTABLE LIMB POCKET

(71) Applicant: Darton Archery LLC, Canton, GA (US)

(72) Inventor: Benjamin D. Blosser, Corydon, KY (US)

(73) Assignee: Darton Archery LLC, Canton, GA (US)

( * ) Notice: Subject to any disclaimer, the term of this patent is extended or adjusted under 35 U.S.C. 154(b) by 129 days.

(21) Appl. No.: 18/907,622

(22) Filed: Oct. 7, 2024

(65) Prior Publication Data

US 2025/0244099 A1 Jul. 31, 2025

Related U.S. Application Data

(60) Provisional application No. 63/626,130, filed on Jan. 29, 2024.

(51) Int. Cl.
*F41B 5/14* (2006.01)
*F41B 5/10* (2006.01)

(52) U.S. Cl.
CPC ..... *F41B 5/1403* (2013.01); *F41B 5/10* (2013.01)

(58) Field of Classification Search
CPC ..... F41B 5/0026
USPC ..... 124/25.6
See application file for complete search history.

(56) References Cited

U.S. PATENT DOCUMENTS

| | | | | |
|---|---|---|---|---|
| 791,821 | A | 6/1905 | Sauve | |
| 4,494,521 | A * | 1/1985 | Quartino | F41B 5/10 124/23.1 |
| 4,644,929 | A | 2/1987 | Peck | |
| 5,487,373 | A | 1/1996 | Smith | |
| 5,515,836 | A | 5/1996 | Martin et al. | |
| 5,720,267 | A | 2/1998 | Walk | |
| 6,371,098 | B1 | 4/2002 | Winther | |
| 7,784,452 | B1 | 8/2010 | Kronengold et al. | |
| 7,832,388 | B1 | 11/2010 | Kronengold et al. | |
| 7,918,218 | B1 | 4/2011 | Kronengold et al. | |
| 7,980,236 | B1 | 7/2011 | Kronengold et al. | |
| 8,776,770 | B2 | 7/2014 | Batdorf | |
| 8,844,508 | B2 | 9/2014 | Sims et al. | |
| 9,389,039 | B2 | 7/2016 | Denton et al. | |
| 9,581,406 | B1 | 2/2017 | Nevels et al. | |
| 9,976,831 | B2 | 5/2018 | Badgerow | |
| 10,883,791 | B2 | 1/2021 | Webster et al. | |
| 11,181,334 | B2 | 11/2021 | Sidebottom et al. | |
| 11,595,627 | B2 | 2/2023 | Webster et al. | |

(Continued)

*Primary Examiner* — Reginald S Tillman, Jr.
(74) *Attorney, Agent, or Firm* — Brooks Kushman P.C.

(57) ABSTRACT

A compound bow includes a riser, a limb pocket on the riser, and a first limb member and a second limb member supported by the limb pocket. The limb members each extend from a first end at the limb pocket to a second end distal to the limb pocket. The limb members each have an inner surface facing the riser and an outer surface facing away from the riser. The limb pocket abuts the outer surfaces of the limb members at the first ends of the limb members and abuts the inner surfaces of the limb members between the first end and second ends. Independently adjustable adjustment devices are supported by the limb pocket and abuts the distal ends of the limb members to independently adjust the position of the first end of the limb member relative to the limb pocket.

20 Claims, 9 Drawing Sheets

(56) References Cited

U.S. PATENT DOCUMENTS

| | | | |
|---|---|---|---|
| 11,668,543 | B2 | 6/2023 | Sidebottom et al. |
| 11,828,566 | B1 | 11/2023 | Hansen et al. |
| 2014/0190461 | A1 | 7/2014 | Sims et al. |

* cited by examiner

COMPOUND BOW INCLUDING ADJUSTABLE LIMB POCKET

CROSS-REFERENCE TO RELATED APPLICATIONS

The subject patent application claims priority to and all the benefits of U.S. Provisional Patent Application No. 63/626,130 filed on Jan. 29, 2024, which is herein incorporated by reference in its entirety.

BACKGROUND

Compound bows include a riser and a pair of limb assemblies extending from opposing ends of the riser. At least one cable extends between the limb assemblies and a bow string extends between the limb assemblies. For example, two cables may extend between the limb assemblies. The compound bow includes cams that are rotatably connected to the limb assemblies. The bow string is connected to the cams and each cable is connected to at least one of the cams. By drawing the string from a brace position to a drawn position, the bow string rotates the cams to draw in the cables and resiliently flexing the limb assemblies toward each other to propel an arrow nocked on the bow string.

The limb may be split limbs. In such examples, the limb includes two limb member elongated away from the riser. A cam is rotatably supported between the limb members. Performance of the cams of the compound bow is dependent on cam lean. Cam lean is the angle of the plane of the cam relative to the central plane of the riser. Performance of the compound bow can be optimized by adjusting the cam lean.

DETAILED DESCRIPTION

Figure 1:
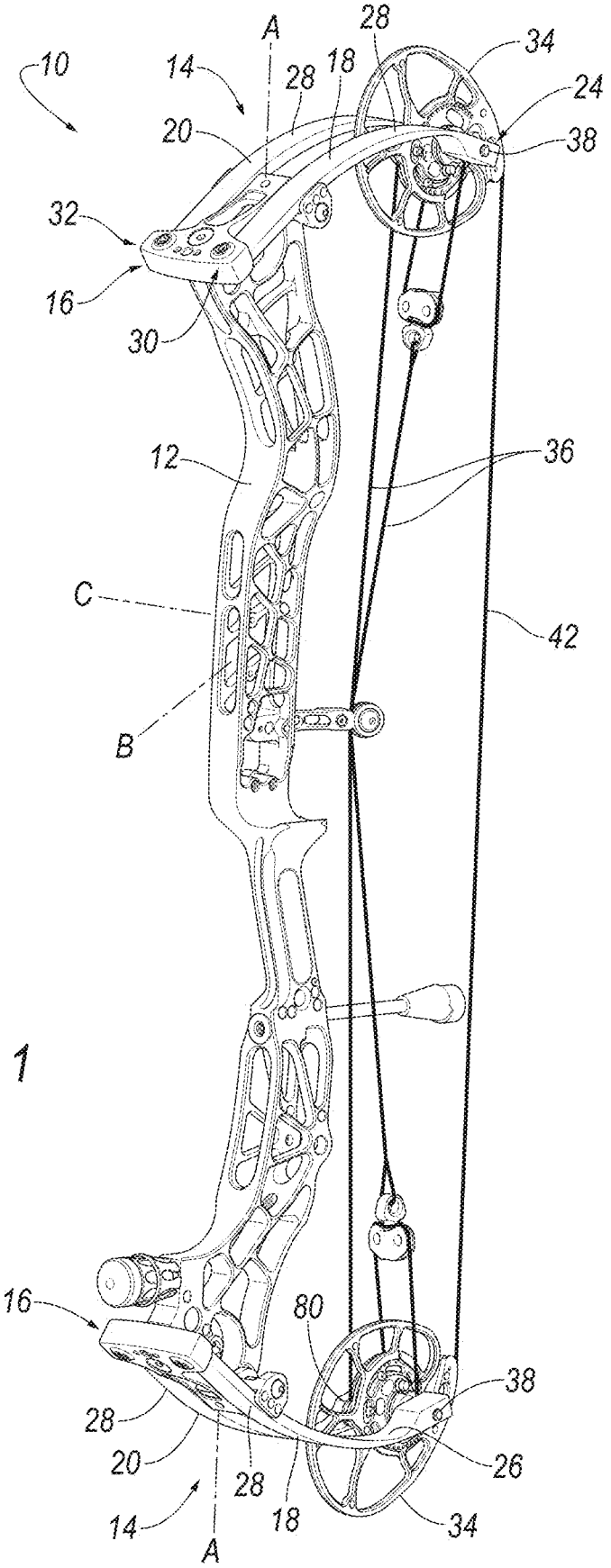
FIG. 1 is a perspective view of a compound bow with adjustable limb pockets.

With reference to the Figures, wherein like numerals indicate like parts throughout the several views, a compound bow 10 includes a riser 12 and a limb pocket 16 on the riser 12. A first limb member 18 and a second limb member 20 each include a first end 22 proximal to the limb pocket 16 and a second end 24 distal to the limb pocket 16. The first limb member 18 and the second limb member 20 each have an inner surface 26 facing the riser 12 and an outer surface 28 facing away from the riser 12. The limb pocket 16 abuts the outer surface 28 of the first limb member 18 at the first end 22 of the first limb member 18, and the limb pocket 16 abuts the outer surface 28 of the second limb member 20 at the first end 22 of the second limb member 20. The limb pocket 16 abuts the inner surface 26 of the first limb member 18 between the first end 22 of the first limb member 18 and the second end 24 of the first limb member 18, and the limb pocket 16 abuts the inner surface 26 of the second limb member 20 between the first end 22 of the second limb member 20 and the second end 24 of the second limb member 20. A first adjustment device 30 is supported by the limb pocket 16 and abuts the first end 22 of the first limb member 18. The first adjustment device 30 is moveable relative to the limb pocket 16 toward and away from the first end 22 of the first limb member 18. A second adjustment device 32 is supported by the limb pocket 16 and abuts the first end 22 of the second limb member 20. The second adjustment device 32 is moveable relative to the limb pocket 16 toward and away from the first end 22 of the second limb member 20. The first adjustment device 30 and the second adjustment device 32 are independently adjustable relative to the limb pocket 16.

The compound bow 10 includes two limbs 14, cams 34 supported on the limbs 14, and cables 36 extending between the cams 34, as described further below. Specifically, each limb 14 includes an axle 38 extending between the limb members 18, 20 and the cam 34 is rotatably supported between the limb members 18, 20 on the axle 38. The cables 36 are in tenson between the limbs 14 to bias the first ends 22 of the limb members 18, 20 against the respective adjustment device 30, 32. Since the first adjustment device 30 and the second adjustment device 32 are independently adjustable relative to the limb pocket 16, the first ends 22 of the first limb member 18 and the second limb member 20 may be independently moved toward and away from the limb pocket 16. The adjustment or the adjustment device 30, 32 pivots the limb member 18, 20. Specifically, the limb pocket 16 includes a platform 40 that abuts the limb members 18, 20 between the first end 22 and the second end 24 of the limb member 18, 20. The adjustment of the adjustment device 30, 32 toward the first end 22 of the limb member 18, 20 pushes the first end 22 of the limb member 18, 20 away from the limb pocket 16 and rotates the limb member 18, 20 about the platform 40 against the tension of the cable 36. The adjustment of the adjustment device 30, 32 away from the first end 22 of the limb member 18, 20 allows the first end 22 of the cable 36 to move toward the limb pocket 16 and allows the limb member 18, 20 to rotate about the platform 40 under tension of the cable 36.

Since the limb members 18, 20 are independently adjustable, the second ends 24 of the limbs 14 can be independently moved relative to each other to optimize cam lean. Specifically, adjustment of the adjustable member moves the first end 22 of the adjustable member and rotates the limb member 18, 20 about the flange, thus moving the second end 24 of the limb member 18, 20. Since the axle 38 is connected to the second end 24 of the limb member 18, 20, the movement of the second end 24 of one of the limb members 18, 20 relative to the second end 24 of the other limb 14 member adjusts the angle of the axle 38, and thus the angle of the cam 34, relative to the second ends 24 of the limb members 18, 20.

Figure 7:
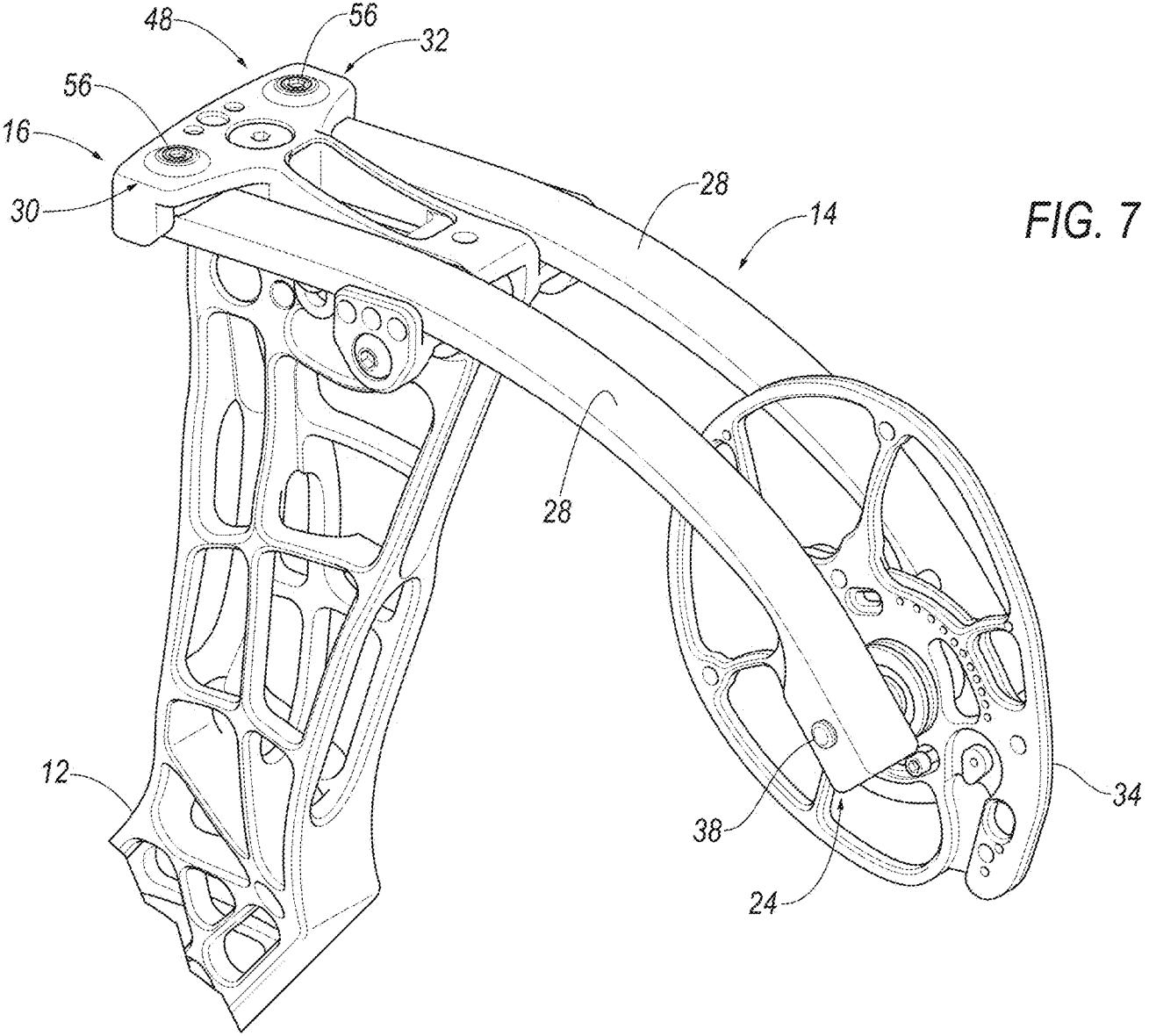
FIG. 7 is a perspective view of a portion of a compound bow with another example adjustable limb pocket.
Figure 8:
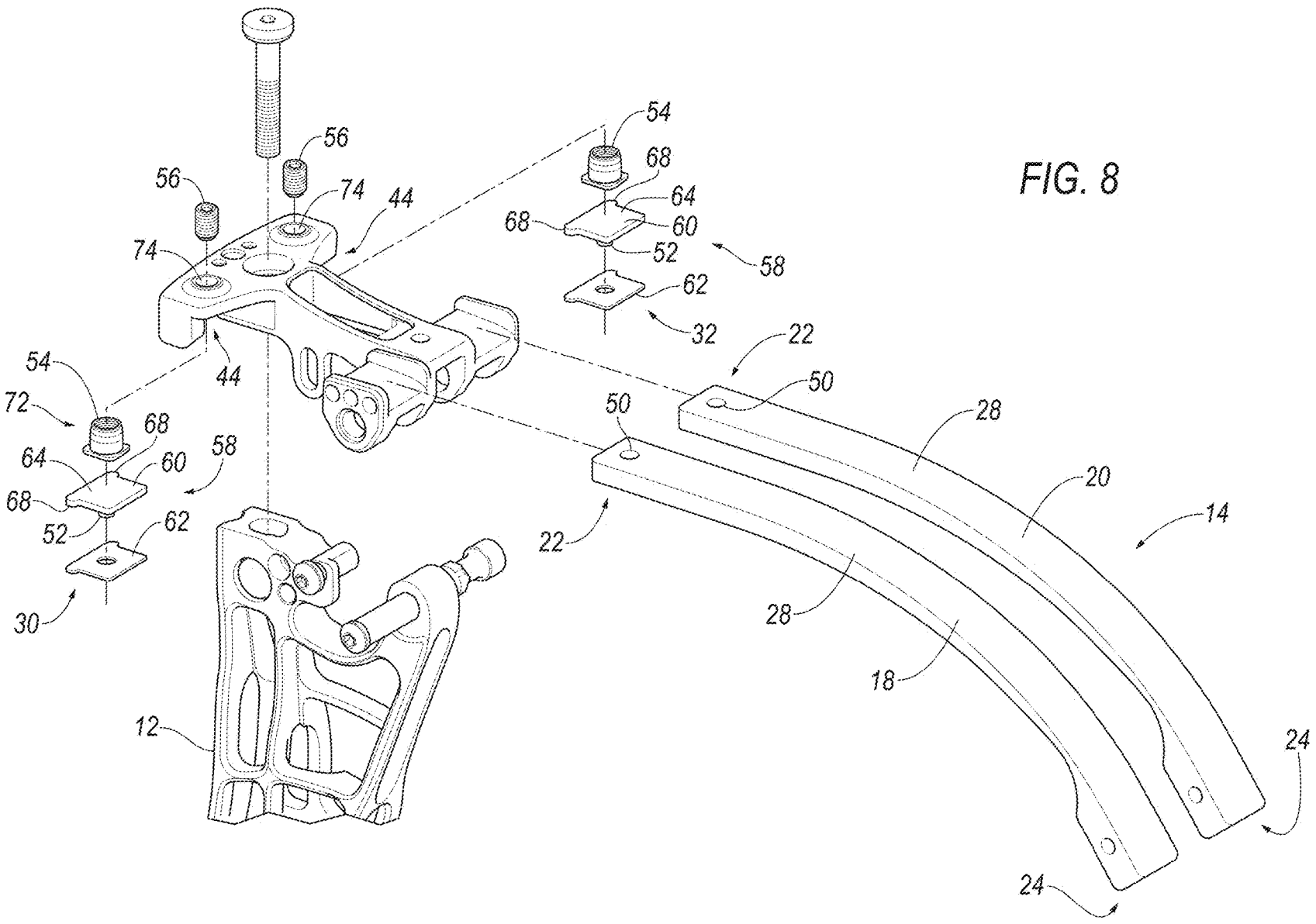
FIG. 8 is an exploded view of FIG. 7.
Figure 9:
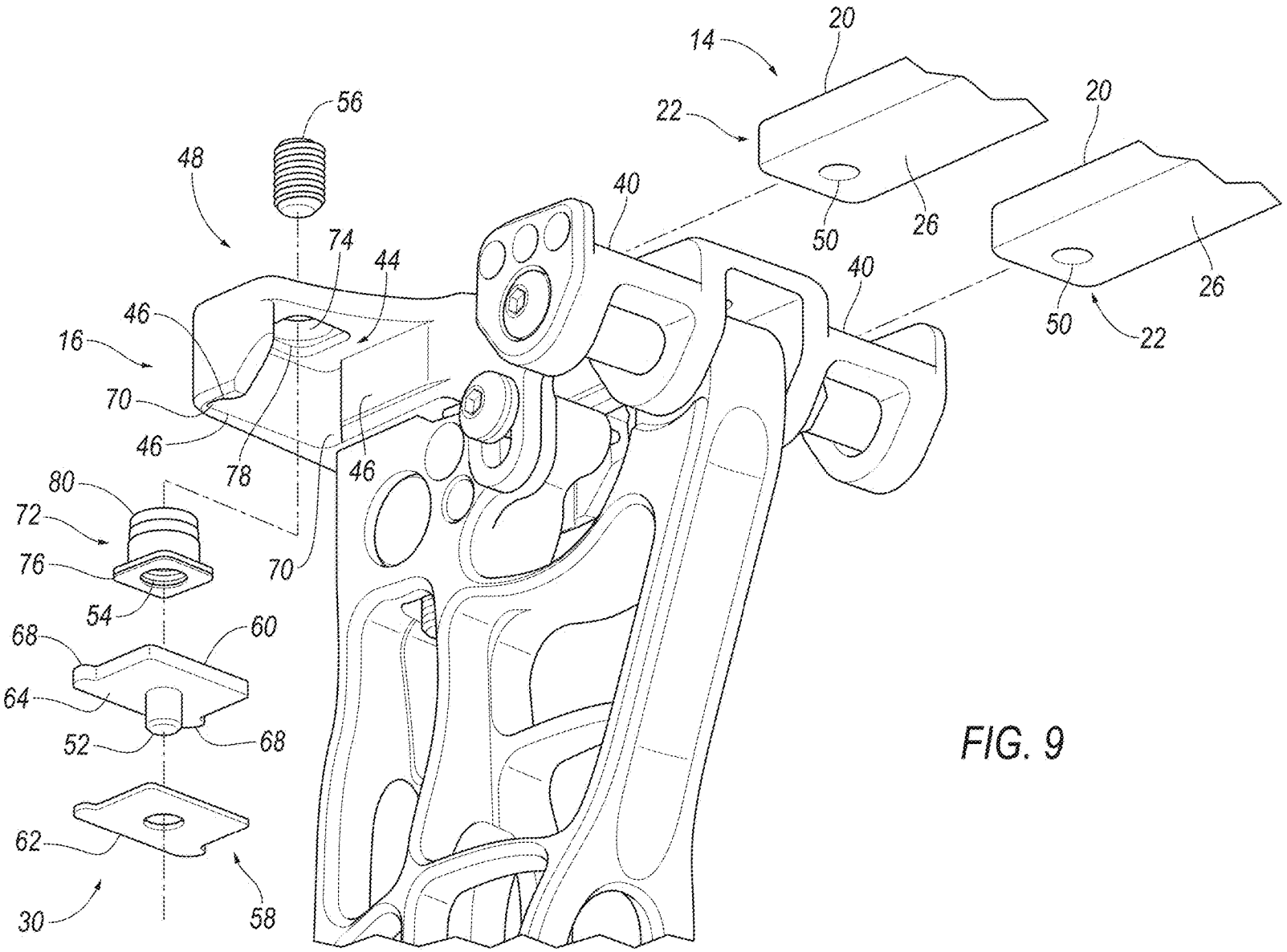
FIG. 9 is another perspective of the exploded view of FIG. 7.

A first example of the adjustment devices 30, 32 is shown in FIGS. 1-6 and a second example of the adjustment devices 30, 32 is shown in FIGS. 7-9. Common numerals are used to identify common features between FIGS. 1-6 and 7-9. The compound bow 10 includes a limb pocket 16, a limb 14, and two adjustment assemblies 30, 32 on both sides of the riser 12 and the description herein is applicable to the components on both sides of the riser 12. Common numerals are used to identify the common features on opposite sides of the riser 12. The numerical adjectives "first" and "second" are used herein as identifiers to distinguish components in the Figures, and the numerical adjectives do not indicate order, location, or importance.

The compound bow 10 includes a pair of limbs 14. The limbs 14, flex to store energy when a bow string 42 is pulled to a drawn position, and the limbs 14 deliver the energy to an arrow nocked on a bow string 42 of the compound bow 10 when the bow string 42 is released. In the example shown in the Figures, the compound bow 10 is a vertical bow and with one limb 14 and cam 34 on the top of the compound bow 10 and with another limb 14 and cam 34 on the bottom of the compound bow 10.

The limbs 14 are split limbs 14. Specifically, each limb 14 includes the first limb member 18 and the second limb member 20. The limb 14 each includes an axle 38 that rotatably supports the cam 34 between the first limb member 18 and the second limb member 20. The axle 38 extends from the first limb member 18 to the second limb member 20 at the second end 24 of the limb members 18, 20. The first limb member 18 and the second limb member 20 may be, for example, fiberglass, carbon fiber, wood, etc.

The limbs 14 extend from opposing ends of the riser 12. The limbs 14 are supported by the riser 12, i.e., the weight of the limb 14 is borne by the riser 12 when a user holds the riser 12. Specifically, the limbs 14 are supported on the riser 12 by limb pocket 16, i.e., the weight of the limbs 14 are borne by the limb pocket 16 and the weight of the limb pocket 16 is borne by the riser 12. At least one cable 36 extends between the limbs 14, and the bow string 42 extends between the limbs 14. For example, two cable 36 extend between the limbs 14 in the example shown in the Figures. In other examples, the bow may include additional cables 36.

One cam 34 is rotatably supported by one of the limbs 14 and the other cam 34 is rotatably supported by the other of the limbs 14. The cable 36 assemblies are connected to both limbs 14, either directly, e.g., to the axle 38, or indirectly, e.g., to the cam 34 on the limb 14.

The cam 34 has at least one track engaged with the cable 36 assembly and/or a bow string 42 and at least one of the tracks is eccentric relative to the rotational axis of the cam 34 on the axle 38. The cam 34 in some examples may include the types that are currently known. The cams 34 and can be of any suitable type. For example, the cams 34, can be a single cam, hybrid cam, dual cam, binary cam, cam and a half, etc.

The bow string 42 extends between the limbs 14. Specifically, the bow string 42 is directly connected to and extends between the cams 34. By drawing the bow string 42 from a brace position to the drawn position, the bow string 42 rotates the cams 34 to draw in the cable 36 assembly and resiliently flex the limbs 14 toward each other. The bow string 42 may be of any suitable type and material including, in some examples, types and materials that are currently known.

With reference to FIG. 1, the riser 12 is elongated along a riser axis A. In operation, the riser axis A is generally vertical. "Bow-rearward" is a direction from the riser 12 toward the torso and head of the operator of the compound bow 10. "Bow-forward" is a direction from the riser 12 away from the torso and head of the operator, i.e., the direction opposite the bow-rearward direction. The compound bow 10 has a fore-and-aft axis B that extends bow-rearward and bow-forward through a front face and a rear face of the riser 12. The fore-and-aft axis B is perpendicular to the longitudinal axis A. "Lateral" is a direction perpendicular to the bow-rearward and bow-forward direction along an axis perpendicular to the longitudinal axis A. The compound bow 10 has a lateral axis C that extends laterally through a left face and a right face. The lateral axis C is perpendicular to the longitudinal axis A and the fore-and-aft axis B. Cam lean may be measured on a plane central to the riser 12 on the fore-and-aft axis B, as is known.

The riser 12 includes a handle. The handle is gripped by the operator of the compound bow 10 to carry the compound bow 10 and to draw the compound bow 10 from the brace position to the drawn position. The handle may be unitary with the rest of the riser 12. The handle is elongated generally along the longitudinal axis A of the riser 12.

The riser 12 may include an arrow shelf, as shown in the example in the Figures. The arrow shelf supports an arrow when an arrow is initially nocked to the bow string 42, i.e., the weight of the arrow is at least partly borne by the arrow shelf. The arrow may abut the arrow shelf when initially nocked to the bow string 42. The arrow shelf may support the arrow when the compound bow 10 is in the drawn position. The arrow shelf is above the handle.

Figure 2:
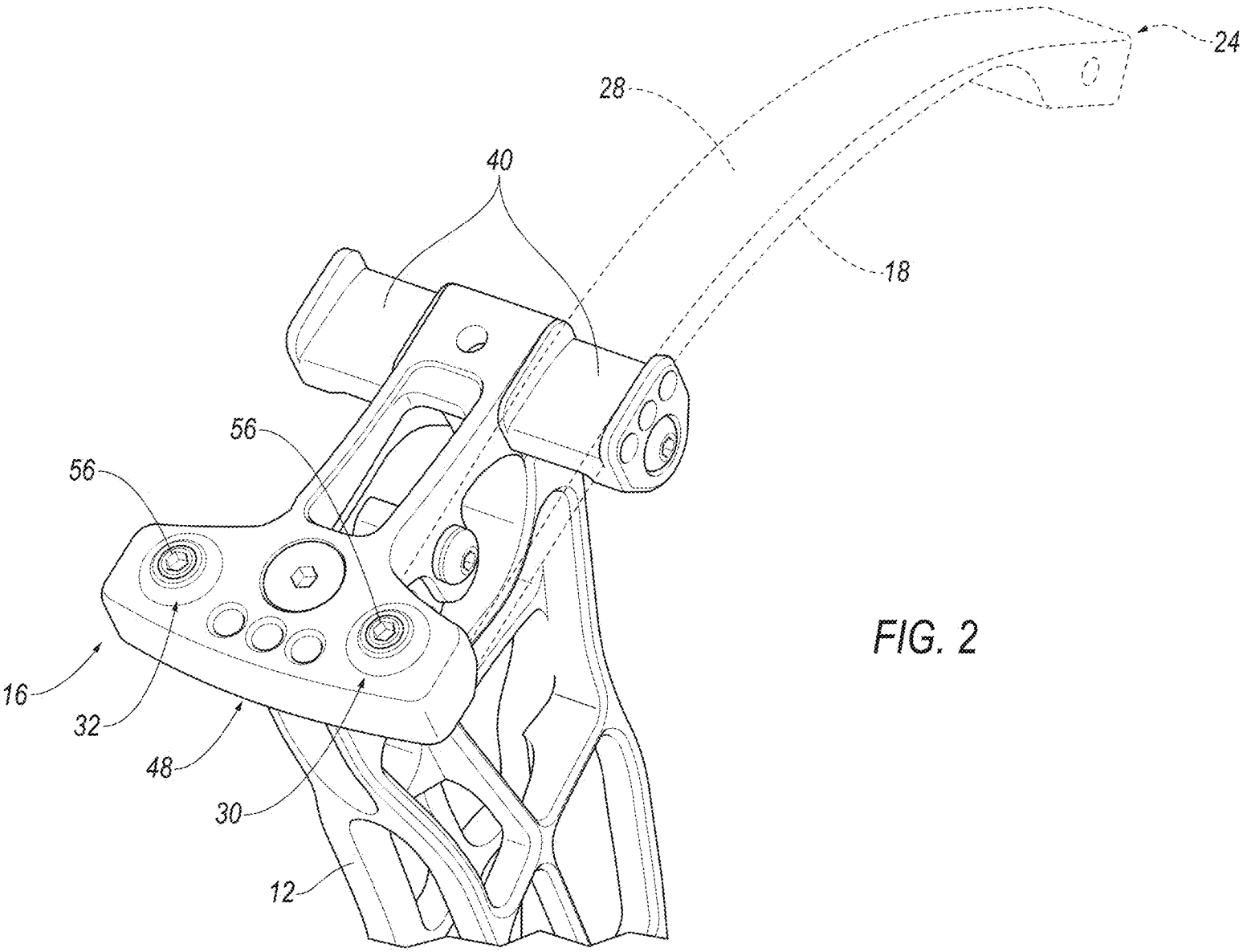
FIG. 2 is a perspective view of a portion of the compound bow with an example of one of the adjustable limb pockets.
Figure 3:
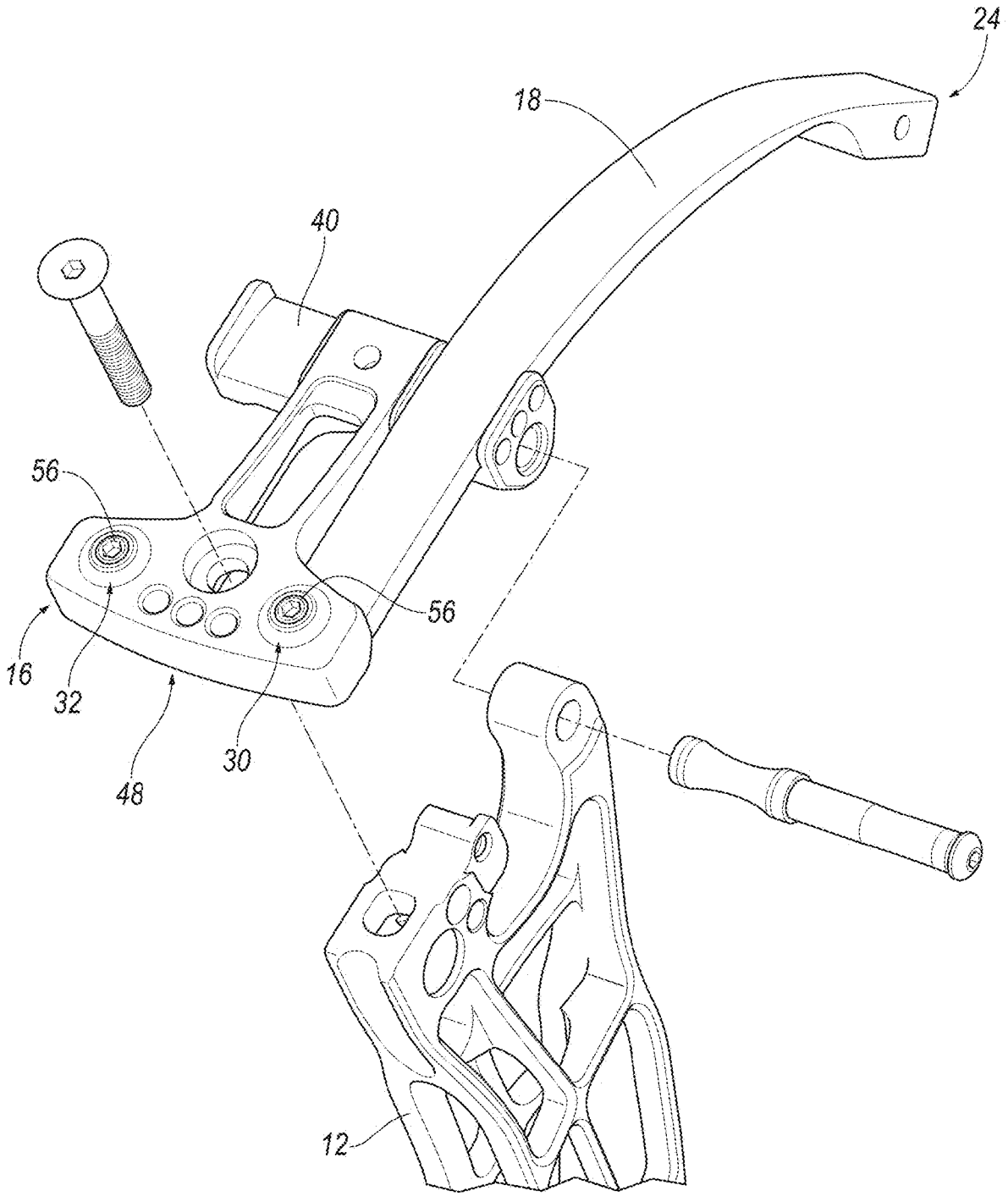
FIG. 3 is an exploded view of the example limb pocket from FIG. 2.

With reference to FIGS. 1-3, the riser 12 may support components of the compound bow 10. For example, the riser 12 may support a quiver, a cable guide, a string suppressor, a sight, a drop-away arrow rest, etc.

Figure 4:
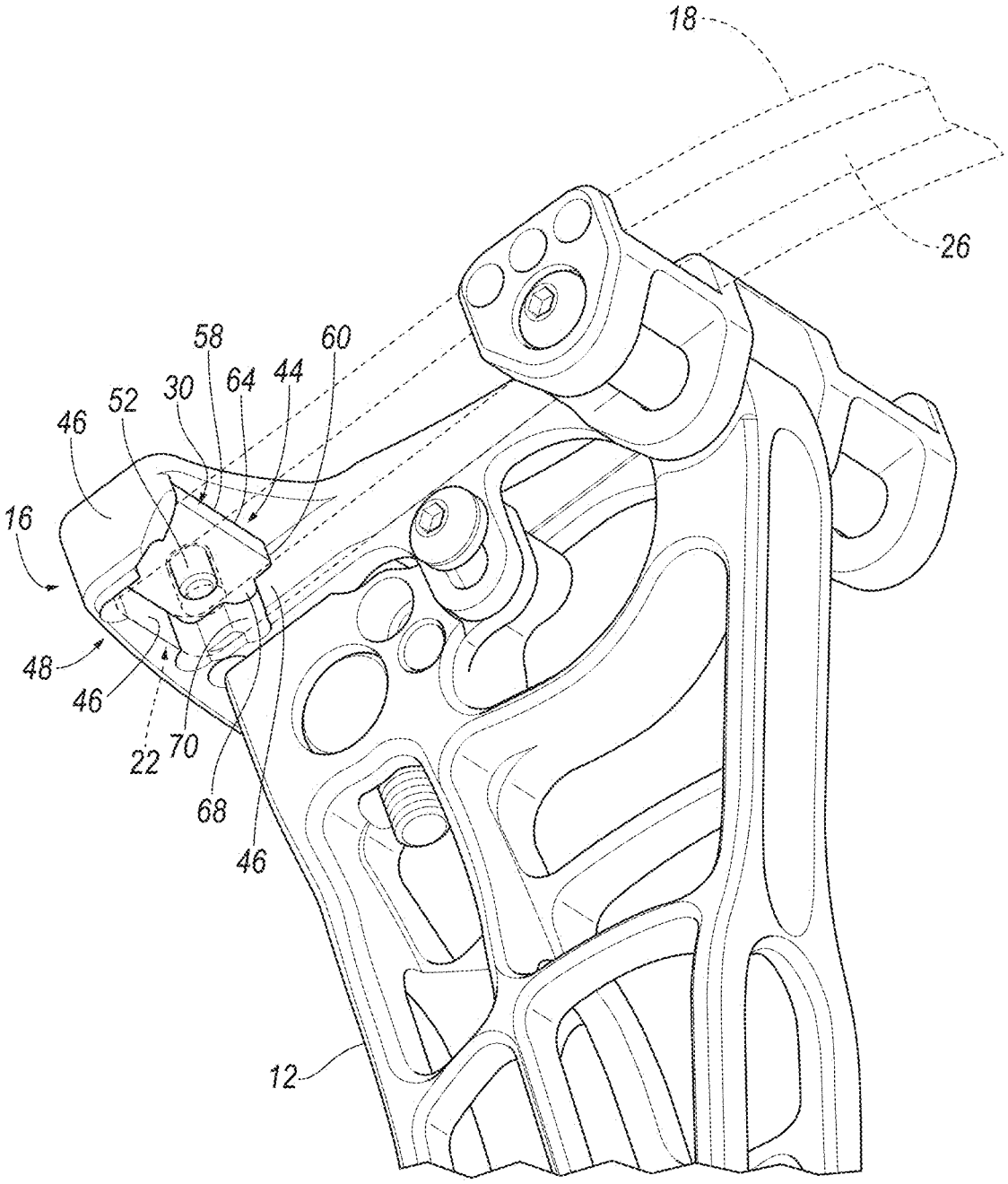
FIG. 4 is another perspective view a portion of the compound bow with the adjustable limb pocket of FIG. 2.
Figure 5:
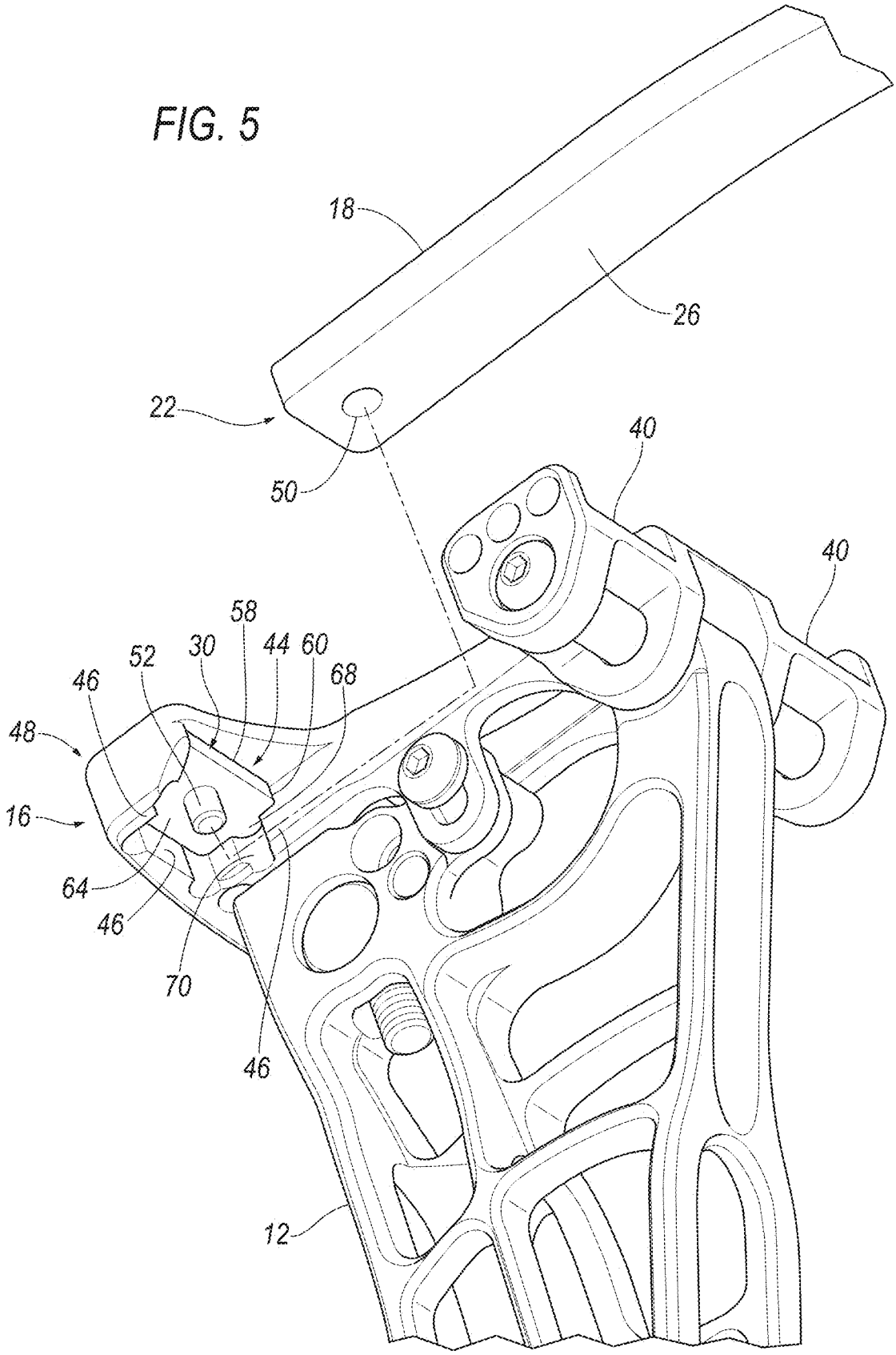
FIG. 5 is a partially-exploded view of FIG. 4.
Figure 6:
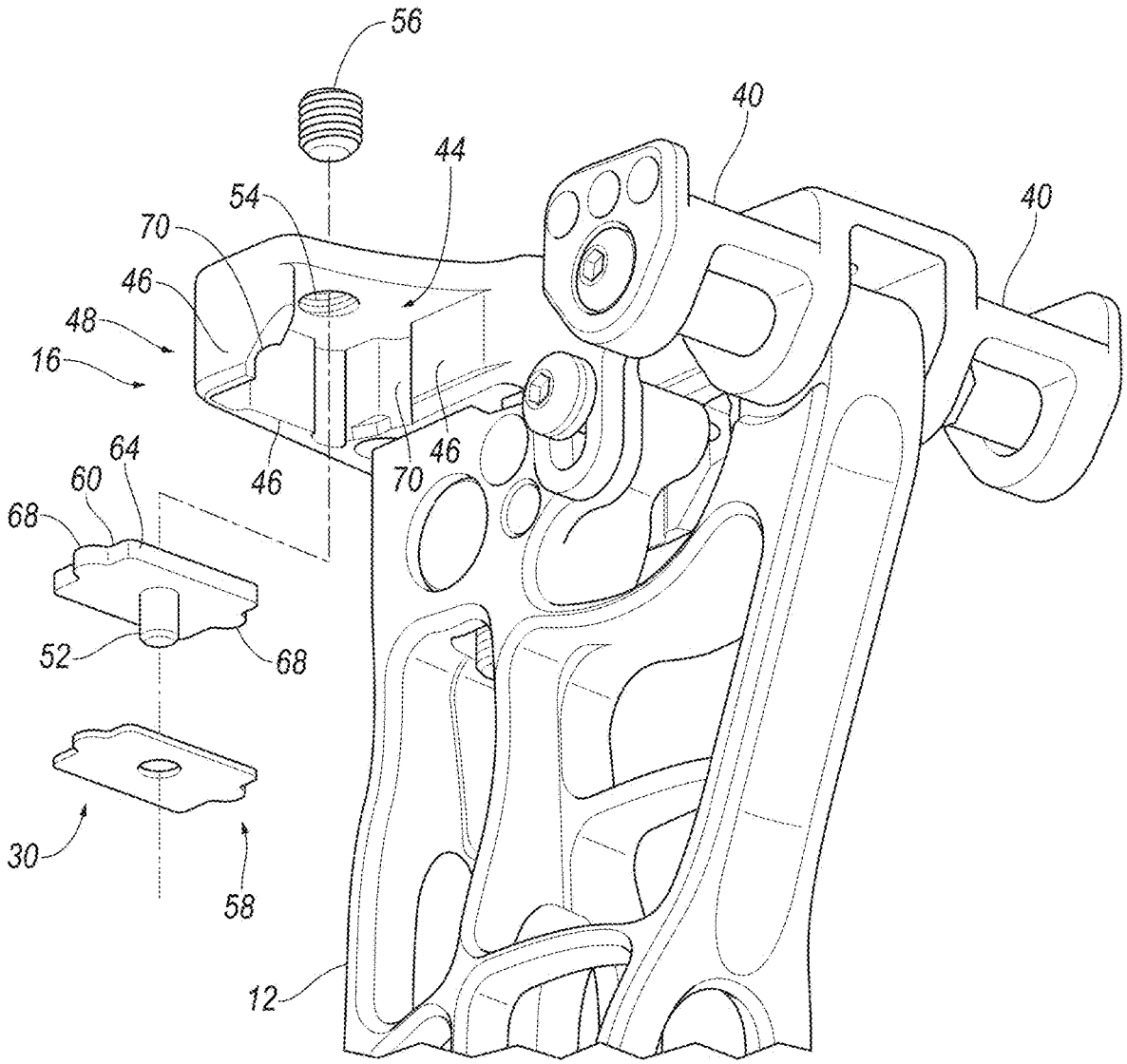
FIG. 6 is an exploded view of a portion of the compound bow and the example limb pocket of FIG. 2.

The limb pocket 16 is fixed to an end of the riser 12. In other words, the limb pocket 16 moves as a unit with the riser 12 and does not move relative to the riser 12, including while the compound bow 10 moves between the brace position and the drawn position. As an example, the limb pocket 16 may be fastened to the riser 12 with fasteners and/or pins, as shown in FIGS. 4 and 5.

The limb pocket 16 includes a head 48 that abuts the first ends 22 of the limb members 18, 20 and supports the adjustment devices 30, 32. The limb pocket 16, specifically the head 48 of the limb pocket 16, defines two recesses 44. One recess 44 receives one limb member 18, 20. The first ends 22 of the limb members 18, 20 are disposed in the recesses 44, respectively. The head 48 includes three walls 46 defining each recess, as shown in FIG. 5. The walls 46 may assist in maintaining the limb members 18, 20 in the recess 44.

The limb pocket 16 includes a platform 40 and the limb members 18, 20 are supported on the platform 40. In the example shown in the Figures, the platform 40 is a continuous to support both limb members 18, 20. In other examples, the platform 40 may include two components being separated by other components and abutting the limb members 18, 20, respectively.

The platform 40 abuts the inner surface 26 of the limb members 18, 20 between the first end 22 and the second end 24 of the limb member 18, 20. The platform 40 operates as a fulcrum between the first end 22 and the second end 24 of the limb member 18, 20. In the brace position and the drawn position of the compound bow 10, the cables 36 apply force to the limb members 18, 20 to pivot the limb members 18, 20 about the platform 40 against the limb pocket 16 at the recesses 44. The cable 36 biases the inner surface 26 of the limb member 18, 20 against the platform 40. Specifically, the cables 36 apply force that pivots the limbs 14 about the platforms 40 toward the respective adjustment device 30, 32. In the examples shown in the Figures, the head 48 and the platforms 40 are unitary. Unitary means a single, uniform piece of material with no seams, joints, fasteners, or adhesives holding it together, i.e., formed together simultaneously as a single continuous unit, e.g., by machining from a unitary blank, molding, forging, casting, etc. Non-unitary components, in contrast, are formed separately and subsequently assembled, e.g., by threaded engagement, welding, etc.

The limb members 18, 20 each including a first end 22 proximal to the limb pocket 16 and a second end 24 distal to the limb pocket 16. The first end 22 is disposed in the recess 44 of the limb pocket 16. The limb member 18, 20 extends from the platform 40 to the second end 24. The axle 38 is supported on the second end 24 of the limb members 18, 20.

The limb members 18, 20 each have an inner surface 26 facing the riser 12 and an outer surface 28 facing away from the riser 12. The outer surface 28 faces an opposite direction than the inner surface 26. The outer surface 28 of the riser 12 faces the recess 44 and abuts the respective adjustment device 30, 32. The inner surface 26 abuts the platform 40.

In the example shown in the Figures, the limb member 18, 20 includes a hole 50 at the first end 22. The hole 50 is aligned with the recess 44. In such examples, the adjustment device 30, 32 may include a post 52 that extends into the hole 50.

The first adjustment device 30 is supported by the limb pocket 16 and abuts the first end 22 of the first limb member 18, and the second adjustment device 32 supported by the limb pocket 16 and abuts the first end 22 of the second limb member 20. The first adjustment device 30 is moveable relative to the limb pocket 16 toward and away from the first end 22 of the first limb member 18, and the second adjustment device 32 being moveable relative to the limb pocket 16 toward and away from the first end 22 of the second limb member 20.

In the example shown in the Figures, the adjustment devices 30, 32 are threadedly engaged with the limb pocket 16 for threaded advancement toward and retreat from the first end 22 of the limb member 18, 20. Specifically, the limb pocket 16 includes a threaded hole 54 threadedly engaging the first adjustment device 30 and another threaded hole 54 threadedly engaging the second adjustment device 32. In such an example, the adjustment devices 30, 32 each include a threaded fastener 56, e.g., set screws as shown in the examples in the Figures. The threaded holes 54 may each extend through the outer surface 28 of the limb pocket 16. The axes of the threaded holes 54 may be parallel to each other.

The adjustment device 30, 32 may include a pad 58 slideably engaged with the limb pocket 16. The pad 58 is driven by the threaded fastener 56 and the pad 58 abuts the first end 22 of the limb member 18, 20. The pad 58 is disposed in the recess 44 and is moveable toward and away from the first end 22 of the limb member 18, 20 by adjustment of the threaded fastener 56.

The pad 58 has a base 60, and in some examples includes a cushion 62 between the base 60 and the first end 22 of the limb member 18, 20. In the example shown in the Figures, the threaded fastener 56 abuts the base 60 and the cushion 62 abuts the first end 22 of the limb 14. In such an example, the base 60 is rigid relative to the cushion 62, i.e., the cushion 62 is resiliently flexible relative to the base 60. Advancement of the threaded fastener 56 along the threaded hole 54 and into the recess 44 moves the base 60 and the cushion 62 toward the first end 22 of the limb member 18, 20. Since the base 60 is rigid relative to the cushion 62, the base 60 transmits advancing movement of the threaded into the recess 44 to pivot the limb member 18, 20 about the platform 40. The cushion 62 transmits the movement to the limb member 18, 20. Since the cushion 62 is flexible relative to the base 60, the cushion 62 cushions the interface between the first end 22 of the limb member 18, 20 and the base 60. Since the cables 36 provide force to pivot the limb member 18, 20 about the platform 40, the limb member 18, 20 moves with the threaded fastener 56 and the base 60 in the event the set screw is retreated from the recess 44 to pivot the limb member 18, 20 about the platform 40. The threaded fastener 56 can be advanced and retreated in the hole with use of a tool, e.g., a wrench, screwdriver, etc. Each of the limbs 14 of the adjustment pad 58 can be independently adjustable with the adjustment of the respective threaded fastener 56, as set forth further below.

The base 60 in the example shown in the figures includes a body 64 and the post 52. As set forth above, the hole in the limb member 18, 20 receives the post 52 to retain the limb member 18, 20 to the limb pocket 16. The base 60 may be, for example, metal, plastic, composite, etc. The cushion 62 may be rubber, plastic, nylon, polymeric of any suitable type, etc.

The pad 58 and the limb pocket 16 may include features to guide movement of the pad 58 in the recess 44 and/or to prevent rotation of the pad 58 relative to the recess 44 when the threaded fastener 56 is rotated for adjustment of the adjustment device 30, 32. In the example shown in the Figures, the pad 58 is slideably engaged with the limb pocket 16 in the recess 44. Specifically, the pad 58 is sized and shaped to slide in the limb pocket 16 when the threaded fastener 56 is rotated. In the example shown in the Figures, the pad 58 is rectangular and the three walls 46 at the recess 44 abut the pad 58 with a sliding clearance fit.

In the example shown in the Figures, the pad 58 includes a boss 68 and the limb pocket 16 includes a groove 70 at the recess 44 that slideably receives the boss 68. For each adjustment device, the threaded fastener 56 has an axis of rotation, and the groove 70 is elongated along the axis of rotation. The groove 70 is elongated away from the first end 22 of the limb member 18, 20 to guide the boss 68, and thus the pad 58, toward and away from the first end 22 when the threaded fastener 56 is rotated. The axes of rotation of the threaded fasteners 56 may be parallel to each other.

In the example shown in FIGS. 1-6, the threaded hole 54 is unitary with the limb pocket 16. In other words, the limb pocket 16 has a hole and the bore of the hole is threaded. In such examples, the threaded hole 54 may be manufactured by machining after formation of the limb pocket 16, as an example. In the example shown in FIGS. 7-9, the limb pocket 16 includes an insert 72 that includes the threaded hole 54. In such an example, the limb pocket 16 includes an unthreaded hole 74 that receives the insert 72. The insert 72 is rotationally fixed in the unthreaded hole 54. As an example, the insert 72 may include a flange 76 that is rotationally fixed to limb pocket 16 and axially slideable relative to the limb pocket 16. In the example shown in the Figures, the limb pocket 16 includes a cavity 78 that is rectangular and the flange 76 is rectangular. The flange 76 and the cavity 78 are sized for a sliding clearance fit. The flange abuts the pad 58. In such an example, the insert includes a barrel 80 extending from the flange 76. The threaded hole 54 extends through the barrel 80 and the flange 76.

Since the adjustment devices 30, 32 are independently adjustable, the lean of both cams 34 may be adjusted with adjustment of one or more of the adjustment devices 30, 32. The compound bow 10 includes four limb members 18, 20, and a dedicated adjustment device adjusts each limb 14 member independent of the other limb members 18, 20. If the cam lean of either cam 34 needs adjustment, the second ends 24 of the limb members 18, 20 supporting that cam 34 can be adjusted independently of each other by operation of the adjustment devise for those two limb members 18, 20.

The disclosure has been described in an illustrative manner, and it is to be understood that the terminology which has been used is intended to be in the nature of words of description rather than of limitation. Many modifications and variations of the present disclosure are possible in light of the above teachings, and the disclosure may be practiced otherwise than as specifically described.

What is claimed is:

1. A compound bow comprising:

a riser;

a limb pocket on the riser;

a first limb member and a second limb member each including a first end proximal to the limb pocket and a second end distal to the limb pocket;

the first limb member and the second limb member each having an inner surface facing the riser and an outer surface facing away from the riser;

the outer surface of the first limb member facing the limb pocket at the first end of the first limb member, and the outer surface of the second limb member facing the limb pocket at the first end of the second limb member; and a first adjustment device and a second adjustment device each supported by the limb pocket, the first adjustment device and the second adjustment device being independently adjustable relative to the limb pocket;

the first adjustment device and the second adjustment device each including a threaded fastener and a pad;

the threaded fastener of the first adjustment device being rotatable relative to the limb pocket;

the pad of the first adjustment device being driven along an axis of the threaded fastener of the first adjustment device by rotation of the threaded fastener of the first adjustment device, and the pad of the first adjustment device abutting the first limb member and being slidable relative to the limb pocket along the axis of the threaded fastener of the first adjustment device;

the threaded fastener of the second adjustment device being rotatable relative to the limb pocket; and the pad of the second adjustment device being driven along an axis of the threaded fastener of the second adjustment device by rotation of the threaded fastener of the second adjustment device, and the pad of the second adjustment device abutting the second limb member and being slidable relative to the limb pocket along the axis of the threaded fastener of the second adjustment device.

2. The compound bow as set forth in claim 1, wherein the pad of the first adjustment device and the pad of the second adjustment device each abut the limb pocket with a sliding clearance fit.

3. The compound bow as set forth in claim 1, wherein:

the limb pocket includes a first set of walls spaced from each other and receiving the pad of the first adjustment device therebetween; and the limb pocket includes a second set of walls spaced from each other and receiving the pad of the second adjustment device therebetween.

4. The compound bow as set forth in claim 3, wherein:

the first limb member includes two side surfaces each extending from the inner surface of the first limb member to the outer surface of the first limb member, the two side surfaces of the first limb member facing walls, respectively, of the first set of walls of the limb pocket;

the second limb member includes two side surfaces each extending from the inner surface of the second limb member to the outer surface of the second limb member, the two side surfaces of the second limb member facing walls, respectively, of the second set of walls of the limb pocket.

5. The compound bow as set forth in claim 4, wherein:

rotation of the threaded fastener of the first adjustment device relative to the limb pocket moves the pad of the first adjustment device along walls of the first set of walls; and rotation of the threaded fastener of the second adjustment device relative to the limb pocket moves the pad of the second adjustment device along walls of the second set of walls.

6. The compound bow as set forth in claim 5, wherein the pad of the first adjustment device and the pad of the second adjustment device each abut the limb pocket with a sliding clearance fit.

7. The compound bow as set forth in claim 1, wherein the limb pocket includes a first threaded hole threadedly engaging the threaded fastener of the first adjustment device and a second threaded hole threadedly engaging the threaded fastener of the second adjustment device.

8. The compound bow as set forth in claim 1, wherein the limb pocket includes a first platform and a second platform, the inner surface of the first limb member facing the first platform and the inner surface of the second limb member facing the second platform.

9. The compound bow as set forth in claim 8, wherein the limb pocket includes a head, the head defining a recess receiving the first end of the first limb member and a recess receiving the first end of the second limb member, the outer surface of the first limb member and the outer surface of the second limb member facing the head, the first platform being spaced from the head along the first limb member and the second platform being spaced from the head along the second limb member.

10. The compound bow as set forth in claim 9, wherein the head, the first platform, and the second platform are unitary.

11. The compound bow as set forth in claim 9, wherein the first platform is spaced from the head along the first limb member between the first end of the first limb member and the second end of the first limb member, and the second platform is spaced from the head along the second limb member between the first end of the second limb member and the second end of the second limb member.

12. The compound bow as set forth in claim 1, further comprising a cable connected to the first limb member and the second limb member, the cable biasing the inner surface of the first limb member and the inner surface of the second limb member toward the limb pocket.

13. A compound bow comprising:

a riser;

a limb pocket on the riser;

a first limb member and a second limb member each including a first end proximal to the limb pocket and a second end distal to the limb pocket;

the first limb member and the second limb member each having an inner surface facing the riser and an outer surface facing away from the riser;

the limb pocket including a first platform and a second platform, the inner surface of the first limb member facing the first platform and the inner surface of the second limb member facing the second platform; and a first adjustment device and a second adjustment device each supported by the limb pocket, the first adjustment device and the second adjustment device being independently adjustable relative to the limb pocket;

the first adjustment device and the second adjustment device each including a threaded fastener and a pad;

the limb pocket defining a first recess receiving the first end of the first limb member and the pad of the first adjustment device, and the limb pocket defining a second recess receiving the first end of the second limb member and the pad of the second adjustment device;

the outer surface of the first limb member being in the first recess at the first end of the first limb member, and the outer surface of the second limb member being in the second recess at the first end of the second limb member;

the threaded fastener of the first adjustment device being rotatable relative to the limb pocket; the pad of the first adjustment device being driven along an axis of the threaded fastener of the first adjustment device by rotation of the threaded fastener of the first adjustment device, and the pad of the first adjustment device abutting the first limb member and being slidable relative to the limb pocket along the axis of the threaded fastener of the first adjustment device; and the threaded fastener of the second adjustment device being rotatable relative to the limb pocket; the pad of the second adjustment device being driven along an axis of the threaded fastener of the second adjustment device by rotation of the threaded fastener of the second adjustment device, and the pad of the second adjustment device abutting the second limb member and being slidable relative to the limb pocket along the axis of the threaded fastener of the second adjustment device.

14. The compound bow as set forth in claim 13, wherein the limb pocket includes a first pair of walls defining the first recess therebetween and a second pair of walls defining the second recess therebetween.

15. The compound bow as set forth in claim 14, wherein:

the first limb member includes two side surfaces each extending from the inner surface of the first limb member to the outer surface of the first limb member, the two side surfaces of the first limb member facing walls, respectively, of the first pair of walls of the limb pocket; and the second limb member includes two side surfaces each extending from the inner surface of the second limb member to the outer surface of the second limb member, the two side surfaces of the second limb member facing walls, respectively, of the second pair of walls of the limb pocket.

16. The compound bow as set forth in claim 13, wherein:

rotation of the threaded fastener of the first adjustment device relative to the limb pocket moves the pad of the first adjustment device along the first recess; and rotation of the threaded fastener of the second adjustment device relative to the limb pocket moves the pad of the second adjustment device along the second recess.

17. The compound bow as set forth in claim 16, wherein the pad of the first adjustment device and the pad of the second adjustment device each abut the limb pocket with a sliding clearance fit.

18. The compound bow as set forth in claim 13, wherein the first platform is disposed along the first limb member between the first end of the first limb member and the second end of the first limb member, and the second platform is disposed along the second limb member between the first end of the second limb member and the second end of the second limb member.

19. The compound bow as set forth in claim 18, further comprising a cable connected to the first limb member and the second limb member, the cable biasing the inner surface of the first limb member toward the first platform, and the cable biasing the inner surface of the second limb member toward the second platform.

20. The compound bow as set forth in claim 1, wherein the limb pocket defines a first recess receiving the first end of the first limb member and a second recess receiving the first end of the second limb member, the first adjustment device being at the first recess and the second adjustment device being at the second recess.

* * * * *